US005967232A

United States Patent [19]

Rhett

[11] Patent Number: 5,967,232

[45] Date of Patent: Oct. 19, 1999

[54] BOREHOLE-CONFORMABLE TOOL FOR IN-SITU STRESS MEASUREMENTS

[75] Inventor: Douglas W. Rhett, Bartlesville, Okla.

[73] Assignee: Phillips Petroleum Company, Bartlesville, Okla.

[21] Appl. No.: 09/007,529

[22] Filed: Jan. 15, 1998

[51] Int. Cl.[6] ..... E21B 49/00

[52] U.S. Cl. ..... 166/250.1; 166/250.17; 73/784

[58] Field of Search ..... 166/250.01, 250.09, 166/250.1, 250.17; 73/783, 784

[56] References Cited

U.S. PATENT DOCUMENTS

| | | | |
|---|---|---|---|
| 2,712,436 | 7/1955 | McCune et al. | 255/28 |
| 2,923,358 | 2/1960 | Hildebrandt | 166/250.1 X |
| 3,046,601 | 7/1962 | Hubbert et al. | 166/250.09 X |
| 3,960,212 | 6/1976 | Hutchison | 166/250.09 |
| 4,529,036 | 7/1985 | Daneshy et al. | 166/254 |
| 5,050,690 | 9/1991 | Smith | 166/250.09 X |
| 5,105,881 | 4/1992 | Thomas et al. | 166/250.01 |
| 5,207,104 | 5/1993 | Enderlin | 73/784 |
| 5,277,062 | 1/1994 | Blauch et al. | 166/250.1 X |
| 5,353,637 | 10/1994 | Plumb et al. | 73/151 |
| 5,511,615 | 4/1996 | Rhett | 166/250.1 |
| 5,743,334 | 4/1998 | Nelson | 166/250.07 |

*Primary Examiner*—Frank Tsay
*Attorney, Agent, or Firm*—George E. Bogatie

[57] ABSTRACT

A downhole tool facilitates in-situ borehole measurement of stress required to initiate a fracture in a desired direction in subterrean formation. The tool is constructed by longitudinally splitting a cylinder in half, and in use the tool includes an inflatable packer disposed within the split cylinder to force each half of the split cylinder against the borehole wall when the packer is inflated. Each half of the split cylinder, which serves as a borehole platen, is made to better conform to an irregular surface of a borehole wall by dividing the split cylinder into multiple segments that are loosely joined so as to allow limited independent movement of each segment with respect to adjacent segments.

17 Claims, 3 Drawing Sheets

BOREHOLE-CONFORMABLE TOOL FOR IN-SITU STRESS MEASUREMENTS

This invention relates to an expandable downhole tool that is conformable to an irregular wall surface of a borehole for use in making in-situ stress measurements, and more particularly to a downhole tool suitable for fracturing a subterranean formation in a desired direction.

BACKGROUND OF THE INVENTION

Formations in the earth are characterized by stress conditions which vary with depth and whose principle directions are generally vertical and horizontal. In the horizontal plane at any point, the horizontal stress reaches a maximum in one direction and a minimum at right angles to the maximum stress direction. Information concerning these maximum and minimum horizontal principle stress conditions is of substantial value in a variety of disciplines such as underground transportation systems, foundations of major structures, cavities for storage of liquids, gases or solids, and in prediction of earthquakes. Further, this information is essential in petroleum exploration and production, e.g. while drilling a well or borehole the information is useful for blowout prevention, in a completed well it is useful for evaluation of hydraulic fracture treatment, and also in determining many critically important aspects of reservoir behavior, such as bulk and pore volume compressibility, permeability, direction of fluid flow, and reservoir compaction/surface subsidence.

Currently, the technique of hydrofracturing is often used to measure the least principle stress in the plane normal to the borehole axis, i.e., the normal plane. In hydrofracturing, the least principle stress in a normal plane is measured with a borehole injection test where the fractures are caused by applying hydraulic pressure on the formation of the borehole. While these injection tests are an accurate means of determining in situ stresses and can be carried out a great depth, they are expensive and time consuming in that they require interruption of drilling to set borehole packers. Further, these tests are difficult to interpret.

In injection tests small volumes of fluid are pumped into small sections of the borehole, which are isolated by inflatable packers, with just enough pressure to create a small fracture. After each fracture of the formation, the pressure decline is measured as fluid leaks off. As long as a fracture is open, this pressure fall off should represent linear flow, and a plot of pressure fall off versus the square root of time should be a straight line. Once the fracture closes, the pressure fall off is no longer linear and the slope of the pressure fall off versus time plot will change. The point where this slope change occurs is interpreted to be the in-situ closure stress, which equals the minimum horizontal stress at that depth.

The use of inflatable packers to isolate a test interval in a borehole is not only time consuming but can present another problem as these packers may cause unwanted fracturing of the formation. This unwanted fracturing would mean that the results of the fractured tests are incorrect.

U.S. Pat. No. 5,511,615 issued on Apr. 30, 1996 to Douglas W. Rhett describes a method and apparatus for in-situ borehole stress determination. This method relies on a down hole jack to independently initiate three spaced apart fractures in a subterranean formation, measuring the breakdown pressure required to initiate each fracture, and finally using the measured breakdown pressures in two-dimensional axial transformation equations to compute the maximum and minimum principal stresses that are active in the plane normal to the borehole axis. The description of U.S. Pat. No. 5,511,615, showing the method for computing the maximum and minimum principal stress based on using measured fractured pressures in axial transformation equations is hereby incorporated by reference.

While the tool described and illustrated in U.S. Pat. No. 5,511,615 provided a substantial advance in the art of borehole stress determination, it has been found that conforming the face of the platens to a borehole wall is difficult because boreholes drilled through rock frequently have wall surfaces that are irregular and even non-cylindrical.

Accordingly it is the object of this invention to improve in-situ stress measurements in fracturing a selected location in a subterranean formation traversed by a borehole.

A more specific object of this invention to provide an expandable downhole tool having surfaces that better conform to an irregular wall of a borehole while applying pressure sufficient to initiate a fracture in the formation surrounding the borehole.

It is yet another object to allow accurate calculation of principle horizontal stress existing in a formation surrounding a borehole.

SUMMARY OF THE INVENTION

According to this invention the foregoing and other objects and advantages are attained by a downhole tool that is an expandable split cylinder. This split cylinder may be configured in one of two ways for conforming to an irregular or non-cylindrical borehole wall. In both configurations, each of the split cylinder sections is divided into multiple strips that form semi-circular arc segments. The strips are arranged in an edgewise vertical stack and loosely held together for use as a flexible semi-circular platen to exert pressure on the wall of the borehole.

In a first preferred embodiment the semi-circular arc segments are connected together by a series of alternating interlocking joints of lobular projections and recesses that allows limited independent movement with respect to adjacent segments, while maintaining the overall longitudinal integrity of the split cylinder.

In a second preferred embodiment straight edge semi-circular arc segments are linked together by one or more cables and the edges of the semi-circular arc segments are beveled to allow limited independent movement of each segment with respect to adjacent segments.

The conformable downhole tool of this invention has platens that better conform to an irregular wall surface in a borehole, thus providing greater accuracy of in-situ pressure measurements required to initiate a fracture in the formation surrounding the borehole.

A BRIEF DESCRIPTION OF THE DRAWINGS

Other features and intended advantages of the present invention will be more readily apparent by reference to the following detailed description in connection with the accompanying drawings, in which.

Figure 2:
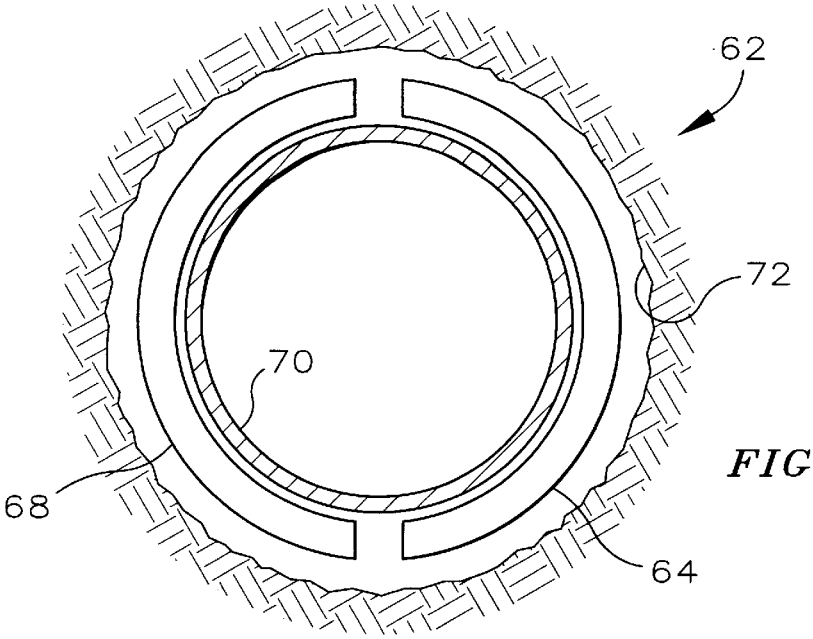
FIG. 2 is a plan view of a first embodiment of a borehole conformable split cylinder, illustrating a condition in a borehole wherein the packer is uninflated.
Figure 5:
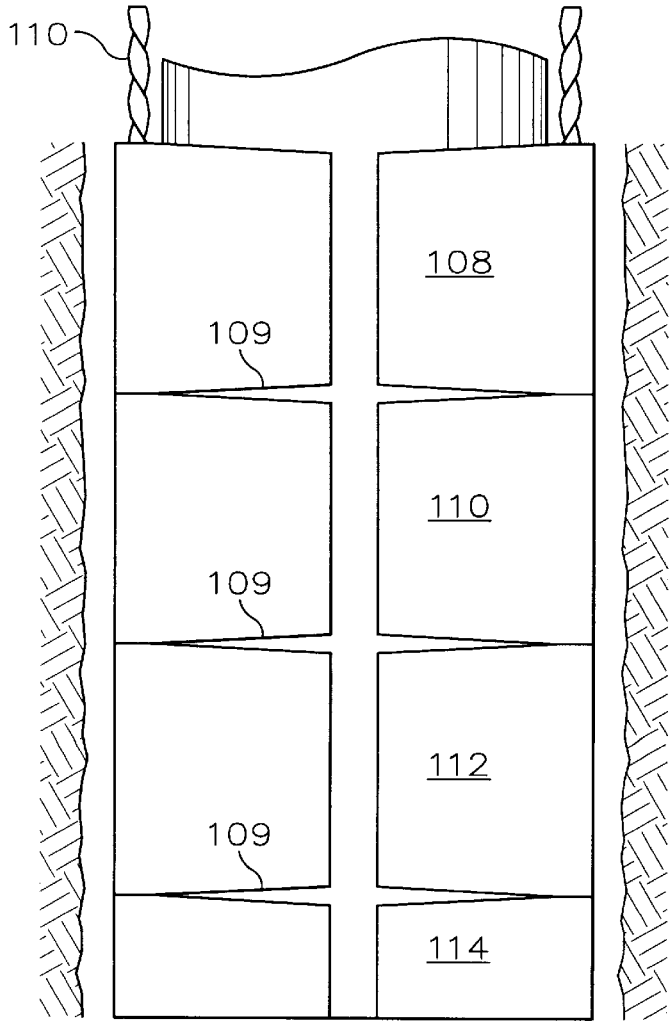
FIG. 5 is an elevation view similar to FIG. 4 showing the second embodiment of the conformable split cylinder.

FIGS. 2 and 5 of U.S. Pat. No. 5,511,615 and the brief descriptions of FIGS. 2 and 5 in U.S. Pat. No. 5,511,615 are hereby incorporated by reference.

DETAILED DESCRIPTION OF THE PREFERRED EMBODIMENT

This invention is directed to a method and apparatus for determining the stress in-situ at a desired location in a borehole, and is applicable to vertically drilled boreholes and boreholes inclined at angles of up to about 25° from the vertical. In accordance with this invention the sum of the pressure exerted by a platen plus the pressure of the drilling fluid provide a breakdown pressure which is required to fail the borehole wall. Breakdown pressure is directly related to the tangential stresses operating on the borehole wall at the fracture location. The tangential stresses measured at the three fracture locations are used to determine the maximum and minimum principle stresses operating in the normal plane, through the standard equations for two-dimensional axial transformation.

Figure 1:
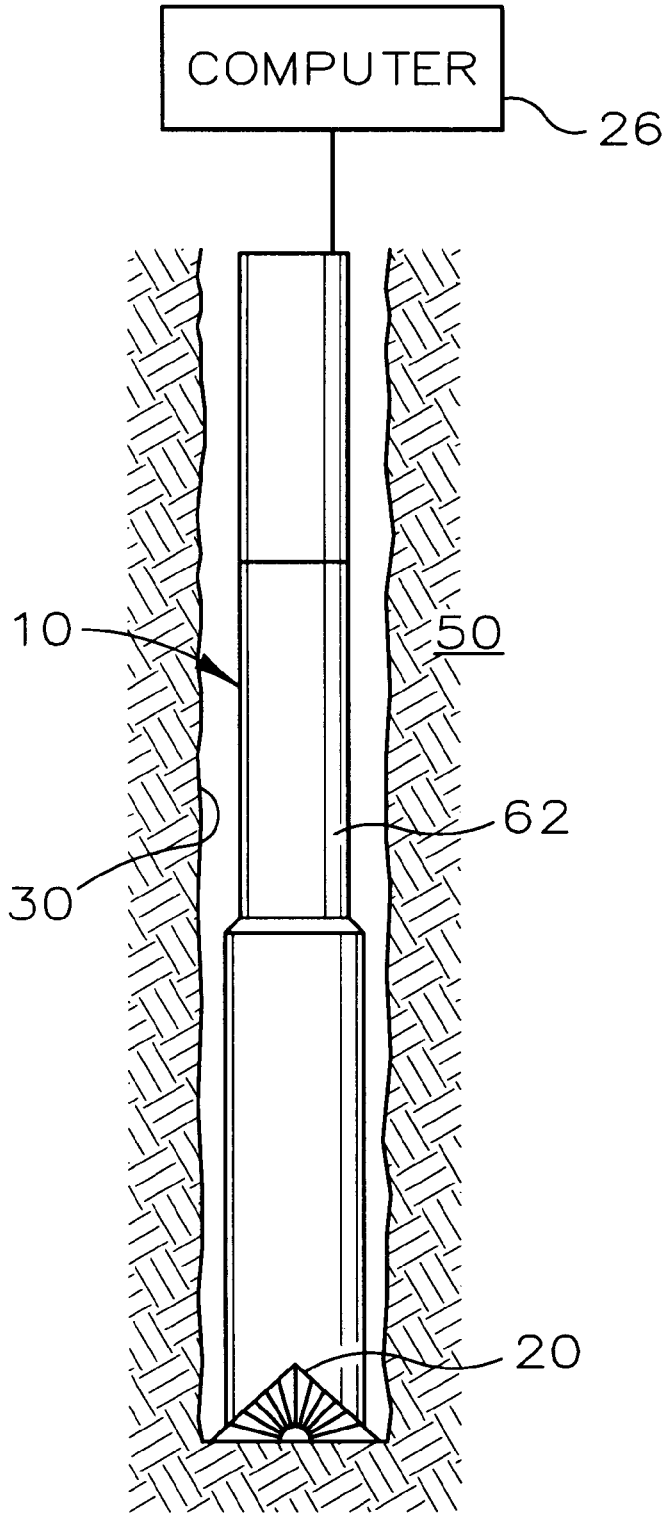
FIG. 1 is a schematic illustration of a wellbore including pressure measuring instruments and the downhole tool for fracturing a subterranean formation.

FIG. 1 illustrates schematically an apparatus located in a wellbore useful in performing in-situ stress measurements in the borehole. The tool 62, which is illustrated attached to a drill string 10, is suspended within the borehole 30 in a formation 50. However, other means known in the art may be used to suspend and position the tool 62 in the borehole. The drill string 10 can include a drill bit 20 attached to the end thereof for penetrating the earth 50 to produce the borehole 30. Disposed within the drill string 10 and preferably approximate to drill bit 20 are a plurality of drill collars 22 including a conformable split cylinder tool 62 and instrumentation for measuring pressure of the drill fluid and the pressure exerted on the borehole wall by the platens of the conformable split cylinder tool. Those skilled in the art are familiar with many drill collars and devices for use in making measurements while drilling (MWD) determinations which are conveniently incorporated within the drill string 20 as one or more drill collars 22. The data obtained by the measuring instruments included within a drill collar 22 is conveniently stored for later manipulation within a computer 26 located at the surface. Those skilled in the art will appreciate that the data is transmitted to the surface by any conventional telemetry system for storage and manipulation in the computer 26.

Figure 3:
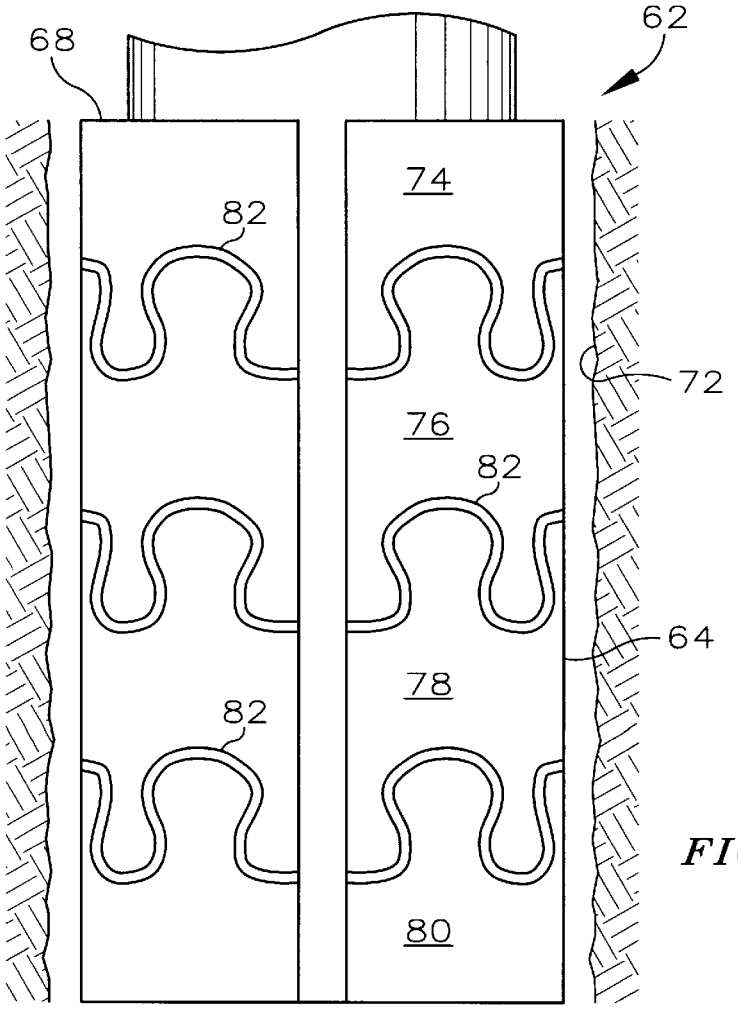
FIG. 3 is an elevation view of the first embodiment of the conformable split cylinder in the borehole showing the series of interlocking lobes and recesses of the segmented split cylinder.
Figure 4:
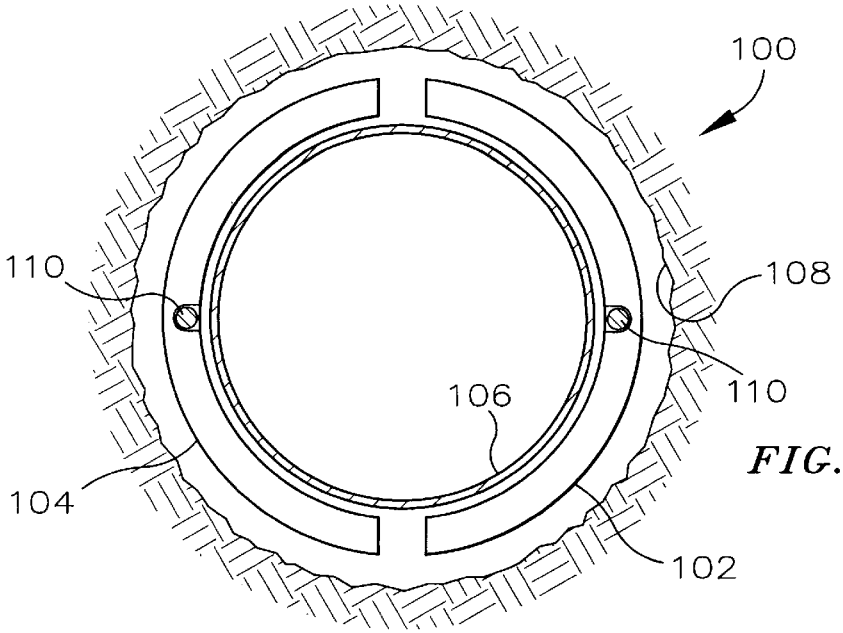
FIG. 4 is a plan view similar to FIG. 3 of a second embodiment of a conformable split cylinder.

Referring now to FIGS. 2 and 3, there is illustrated respectively a plan view and an elevation view of a first embodiment of the down hole tool 62 of the present invention. FIGS. 4 and 5 which are similar to FIGS. 2 and 3, show a second embodiment of the downhole tool 62. The tool 62 in each of the two embodiments is a hollow cylinder that is vertically split along a diameter to form two semi-circular arc sections 64 and 68, which in use surround an inflatable packer 70 in a borehole 30. The two embodiments are also similar in vertical length of the split cylinder, which at present is preferably about five diameters of the tool 62, or equivalently about five times the diameter of the anticipated borehole.

In operation a borehole packer 70 is inflated as is known in the art and the expanded packer forces the two split cylinder sections 64 and 68 outwardly such that the sections serve as platens to exert pressure on the borehole wall 30. Pressure measurements are then made which indicate a formation fracture as described in the previously incorporated reference to U.S. Pat. No. 5,511,615.

In accordance with this invention the split cylinder section 64 and 68 are divided into multiple segments as best illustrated at reference numerals 74, 76, 78, and 80 in FIG. 3. While four segments are illustrated and presently preferred, any suitable number of segments may be employed depending on the condition of the borehole wall 30.

The segments of this split cylinder shown in FIG. 3 may be formed by cutting the split section into multiple strips at longitudinally spaced locations along the wavy lines 82. This cutting divides the section of split cylinder into a desired number of articulate strips which can be edgewise interconnected to form a surface that is free for limited relative movement with adjacent segments, thus giving the split cylinder as a unit the desired radial flexibility while maintaining longitudinal integrity. The wavy line cuts 82 preferably form on the successive segments a number of inter-engaging lobes and recesses, which effectively retains the segment against longitudinal separation, while at the same time permitting limited relative horizontal movement. The cuts 82 may be formed by any suitable means such as a welding torch, with the width of the cut being sufficiently great to allow looseness between successive segments.

A plan view of the second preferred embodiment of the borehole conformable tool is shown generally at 100 in FIG. 4. This view includes the split cylinder sections 102 and 104, surrounding an inflatable packer 106. The tool, as illustrated, is located in a borehole 30. Also illustrated in FIG. 4 is a cable 110 that supports multiple segments of the split cylinders 102 and 104 as will be more fully explained hereafter. Segments of the split cylinder, illustrated at 108, 110, 112 and 114 are formed by cutting the split section at longitudinally spaced locations along straight lines 109 by any suitable means such as a welding torch, to divide the split cylinder into a desired number of segments as shown in FIG. 5. The thus formed segments are shown as connected together by a single cable 110, however, two or more cables may be employed if desired. The split cylinder segments are loosely connected together by the cable 110, and the edges of the segments are beveled to allow linked, and limited independent movement as the packer 106 is inflated.

In this disclosure there is shown and described only the preferred embodiments of this invention as applied to oil production or exploration. It is to be understood that the invention is applicable to various other environments, accordingly various changes or modifications possible by those skilled in the art are within the scope of the inventive concept expressed herein.

That which is claimed is:

1. A borehole conformable downhole tool comprising:

(a.) a pair of flexible semi-circular platens adapted for conforming to the surface of an irregular borehole wall, said platens comprising:

i) a plurality of semi-circular shaped strips having a flat outer side and edges, wherein said plurality of strips are loosely joined together along said edges to define a surface for said flexible platen, and ii) wherein said plurality of joined strips are adapted for limited relative horizontal movement, and (b.) an inflatable borehole packer adapted for forcing said pair of flexible platens against the wall of said borehole, wherein the pressure exerted by said pair of platens is sufficient to initiate a fracture in the formation surrounding said borehole.

2. A borehole conformable downhole tool in accordance with claim 1, wherein said plurality of semi-circular shaped strips each have a series of alternating curve edge lobes and corresponding edge recesses along at least one edge and wherein interconnection of said lobes and said recesses is effective for joining said strips along an edge.

3. A downhole tool in accordance with claim 1, wherein said plurality of semi-circular shaped strips are joined together along the edges by at least one length of cable which traverses said flat sides.

4. A downhole tool in accordance with claim 1, additionally comprising: a split cylinder, wherein said cylinder is split into two equal parts along its longitudinal axis; and means for cutting said split cylinder parts to form said plurality of semi circular shaped strips.

5. A downhole tool in accordance with claim 4 wherein the length of said split cylinder is about five times the diameter of said borehole and the surface of said flexible platen includes at least about four of said semi-circular shaped strips.

6. A borehole conformable tool in accordance with claim 1 additionally comprising means for using said tool to initiate a plurality of independent fractures in the wall of said borehole and for obtaining a plurality of actual breakdown pressure measurements for said formation corresponding to said plurality of fractures.

7. A borehole conformable tool in accordance with claim 1, wherein said plurality of pressure measurements are obtained while drilling said borehole.

8. A borehole conformable tool in accordance with claim 7, wherein said actual breakdown pressure is the sum of drilling fluid pressure in said borehole and the pressure exerted on said wall by said borehole conformable tool on initiation of said fracture.

9. A borehole conformable tool in accordance with claim 7, wherein said borehole is a wellbore and said wellbore is drilled at an angle from the vertical not exceeding twenty-five degrees.

10. A borehole conformable tool in accordance with claim 7, additionally comprising a digital computer programmed to compute values for stress according to equations of the form:

$$A=[S_i+S_j+S_k]/3$$

$$B=(\sqrt{2}/3))[S_i-S_j)^2+(S_j-S_k)^2+(S_i+S_k^2)^{0.5}$$

$$R'_{max}=A+B$$

$$R_{max}=R'_{max}+bp$$

$$R'_{min}+A-B$$

and $$R_{min}=R'_{min}+bp$$

where:

S=stress applied by borehole tool, psi;

i, j and k=index for direction of stress relative to a specified direction or azimuth, where:

$S_i>S_j>S_k$, and bp=drilling fluid pressure.

11. A method for determining stress conditions of a subterranean formation traversed by a borehole, wherein the stress acts in a plane normal to said borehole at a depth corresponding to the depth of said formation, said method comprising the following steps:

using a borehole conformable downhole tool for measuring a first, a second, and a third parameter in a borehole, said tool comprising:

(a) a pair of flexible semi-circular platens adapted for conforming to the surface of an irregular borehole wall, said platens comprising:

i) a plurality of semi-circular shaped strips having a flat outer side and an edge, wherein said plurality of strips are loosely joined together along said edges to define a surface for said flexible platen, and ii) wherein said plurality of joined strips are adapted for limited relative horizontal movement;

(b) an inflatable borehole packer adapted for forming said pair of flexible platens against the wall of said borehole, wherein the pressure exerted by said pair of platens is sufficient to initiate a fracture in the formation surrounding said borehole;

(c) wherein said first, second, and third parameters are respectively the actual pressures required along first, second, and third borehole diameters, which are angularly offset by an angle of about sixty degrees, required to fracture said subterranean formation; and (d) calculating the minimum principal stress and the maximum principal stress operating in said normal plane based on using said first, second and third parameters in standard equations for two-dimensional axial transformation.

12. A method in accordance with claim 11, wherein said first, second and third parameters are measured while drilling said borehole.

13. A method in accordance with claim 11, wherein the actual pressure at a location in said borehole comprises the sum of drilling fluid a pressure in said borehole and pressure exerted on the wall of said borehole by a said borehole conformable tool.

14. A method in accordance with claim 11, wherein said maximum radial stress is calculated according to equations of the form:

$$A=[S_i+S_j+S_k]/3$$

$$B=(\sqrt{2}/3))[(S_i-S_j)^2+(S_j-S_k)^2+(S_i-S_k)^2]^{0.5}$$

$$R'_{max}=A+B$$

$$R_{max}=R'_{max}+bp$$

where:

S=stress applied by borehole conformable tool, psi;

i, j and k=index for direction of stress relative to a specified direction or azimuth; where:

$S_i>S_i>S_k$, and bp=drilling fluid pressure.

15. A method in accordance with claim 14, wherein said minimum principal stress is calculated according to equations of the form:

$$R'_{min}+A-B,$$

and $$R_{min}=R'_{min}+bp.$$

16. A method in accordance with claim 15, additionally comprising computing the maximum and minimum principal stresses operating in the normal plane according to the equations:

$$\sigma_{\max} = \frac{3R_{\max}}{8} + \frac{R_{\min}}{8} + \frac{P_p}{2},$$

$$\sigma_{\min} = [R_{\min} + \sigma_{\max} + P_p]/3$$

17. A method in accordance with claim 12, wherein said borehole is a wellbore and said wellbore is drilled at an angle from the vertical not exceeding twenty-five degrees.

* * * * *